US012037780B2

(12) United States Patent
Kang

(10) Patent No.: US 12,037,780 B2
(45) Date of Patent: Jul. 16, 2024

(54) METHOD FOR CONSTRUCTING RELOCATABLE BUILDING BY USING MODULES

(71) Applicant: NRB INC., Gunsan-si (KR)

(72) Inventor: Keonwoo Kang, Seoul (KR)

(73) Assignee: NRB INC., Gunsan-si (KR)

( * ) Notice: Subject to any disclaimer, the term of this patent is extended or adjusted under 35 U.S.C. 154(b) by 172 days.

(21) Appl. No.: 17/911,380

(22) PCT Filed: Oct. 16, 2020

(86) PCT No.: PCT/KR2020/014136
§ 371 (c)(1),
(2) Date: Sep. 13, 2022

(87) PCT Pub. No.: WO2021/187708
PCT Pub. Date: Sep. 23, 2021

(65) Prior Publication Data

US 2023/0103008 A1 Mar. 30, 2023

(30) Foreign Application Priority Data

Mar. 19, 2020 (KR) ..... 10-2020-0033666

(51) Int. Cl.
*E04B 1/343* (2006.01)
*E04B 1/348* (2006.01)

(52) U.S. Cl.
CPC ..... *E04B 1/34315* (2013.01); *E04B 1/34861* (2013.01)

(58) Field of Classification Search
CPC ..... E04B 1/34315; E04B 1/34861
USPC ..... 52/79.5
See application file for complete search history.

(56) References Cited

U.S. PATENT DOCUMENTS 1,185,871 A * 6/1916 Broughton ..... E04B 7/08 52/262
3,503,170 A * 3/1970 Shelley ..... E04B 1/34823 D25/4
3,643,390 A * 2/1972 Shelley ..... E04B 1/34823 52/234
4,136,492 A * 1/1979 Willingham ..... E04B 1/34823 52/79.14

(Continued)

FOREIGN PATENT DOCUMENTS

BE 882791 A * 10/1980 ..... B65D 90/0013
CN 107130689 A * 9/2017 ..... E04B 1/34315

(Continued)

*Primary Examiner* — Brian D Mattei
*Assistant Examiner* — Joseph J. Sadlon
(74) *Attorney, Agent, or Firm* — Rabin & Berdo, P.C.

(57) ABSTRACT

Proposed is a method for constructing a relocatable building by using modules, the method including a step a) of preparing a single module and installing a foundation block at a site, a step b) of forming a complex module having one room by assembling at least two single modules with each other on an assembly table near the site, a step c) of lifting the assembled complex module and installing the complex module on the foundation block, and a step d) of installing a roof module on an uppermost complex module and integrally reinforcing the foundation block, the complex module, and the roof module by using a reinforcing means.

7 Claims, 13 Drawing Sheets

(56) References Cited

U.S. PATENT DOCUMENTS 4,138,833 A * 2/1979 Townend ..... E04H 1/005 52/79.14
4,185,423 A * 1/1980 Gutierrez ..... E04B 1/34823 52/745.03
4,248,020 A * 2/1981 Zielinski ..... E04F 11/02 52/185
4,364,206 A * 12/1982 Wybauw ..... E04B 1/3483 52/79.9
4,485,608 A * 12/1984 Kaufman ..... E04B 1/10 156/92
4,580,776 A * 4/1986 Burkinshaw ..... E04H 3/24 312/258
5,384,993 A * 1/1995 Phillips ..... E04B 1/34347 52/223.6
5,531,054 A * 7/1996 Ramirez ..... E04H 9/14 52/95
6,016,634 A * 1/2000 Sayer ..... E04B 1/2403 52/648.1
6,058,672 A * 5/2000 McClellan ..... E04B 1/043 52/592.1
6,119,409 A * 9/2000 Makar ..... A42B 1/201 52/79.5
6,178,714 B1 * 1/2001 Carney, Jr. ..... E04B 1/34315 52/564
6,625,940 B2 * 9/2003 Sanger ..... E04G 21/161 52/127.2
6,892,498 B1 * 5/2005 Roman ..... E04B 1/10 52/592.1
6,983,567 B2 * 1/2006 Ciotti ..... E04B 1/3442 52/79.5
7,594,361 B2 * 9/2009 Tragant Ruano ..... E04G 21/161 220/4.27
7,665,257 B2 * 2/2010 Posey ..... E04B 7/04 52/223.13
8,186,110 B2 * 5/2012 Green ..... E04B 1/34807 52/79.9
8,347,560 B2 * 1/2013 Gyory ..... E04B 1/34363 52/79.5
8,555,559 B2 * 10/2013 DiGregory ..... E04B 1/3445 52/79.5
8,615,967 B1 * 12/2013 Figovsky ..... E04B 1/164 52/79.5
9,206,595 B2 * 12/2015 Rutledge ..... E04B 1/34315
9,745,764 B2 * 8/2017 Fisher ..... E04B 1/34823
9,874,009 B2 * 1/2018 Espinosa ..... E04B 1/4157
10,337,184 B2 * 7/2019 Coupe ..... E04B 1/34315
10,443,228 B2 * 10/2019 Chaillan ..... E04H 1/005
10,526,780 B2 * 1/2020 Espinosa ..... E04C 3/292
11,174,630 B2 * 11/2021 Bowron ..... E04B 1/2604
11,739,521 B2 * 8/2023 Lim ..... E04B 1/165 52/125.1
2005/0108957 A1 * 5/2005 Quesada ..... E04B 1/34869 52/143
2006/0225371 A1 * 10/2006 Shanni ..... E04B 1/3442 52/79.5
2007/0144079 A1 * 6/2007 Hourihan ..... E04B 1/34807 52/79.1
2007/0163184 A1 * 7/2007 Olesch ..... E04B 1/34838 52/79.5
2010/0064600 A1 * 3/2010 Napier ..... E04B 1/3442 52/79.5
2011/0023383 A1 * 2/2011 Brouillard ..... E04B 1/34823 52/745.15
2011/0185646 A1 * 8/2011 Kovel ..... E04B 1/24 52/79.9
2012/0255240 A1 * 10/2012 Shen ..... E04B 1/34807 52/79.5
2014/0318036 A1 * 10/2014 Eom ..... H01Q 1/1214 52/79.1
2015/0101263 A1 * 4/2015 Price ..... E04B 1/34321 52/169.1
2015/0337527 A1 11/2015 Wallance
2016/0069062 A1 * 3/2016 Dynon ..... E04B 1/343 52/79.5

FOREIGN PATENT DOCUMENTS

EP 2175088 A2 * 4/2010 ..... E04B 1/34807
FR 1294913 A * 6/1962 ..... E04B 1/3408
FR 3002250 A1 * 8/2014 ..... E04B 1/34315
JP 5707418 B2 4/2015
KR 20-0200410 Y1 10/2000
KR 10-0851878 B1 8/2008
KR 2017086457 A * 7/2017 ..... E04B 1/34384
KR 10-1829017 B1 2/2018
KR 10-2136077 B1 7/2020

* cited by examiner

METHOD FOR CONSTRUCTING RELOCATABLE BUILDING BY USING MODULES

TECHNICAL FIELD

The present disclosure relates generally to a method for constructing a building by using modules. More particularly, the present disclosure relates to a method for constructing a relocatable building in which modules manufactured in a factory are transported to a site and are simply assembled with each other at the site so as to construct a building, which has repeated same sections, such as a school, an apartment, a hospital, a lodging facility, an office, and an accommodation facility, etc., and the disassembly of the modules is easy and reuse rate of the modules is high.

BACKGROUND ART

Due to eco-friendly policies on pollution prevention and waste treatment at construction sites, and reduction of working hours according to a recently implemented 52-hour workweek system, etc., a construction environment which has been centered on a wet construction method and labor is more eco-friendly and minimizes construction manpower through the industrialization of architecture. In addition, an urgent need for emergency hospital facilities due to the spread of unexpected infectious diseases and a need for a temporary school building for education during the reconstruction of an aged school building are playing a role in further accelerating the industrialization of the aforementioned architecture.

The industrialization of architecture means that building members and parts are standardized, mass-produced in factories, and assembled at a site to complete the construction of a building. That is, industrialized architecture minimizes on-site processes and maximizes work in a factory so as to shorten a construction period, to improve quality, and to improve the reuse rate of materials such that eco-friendly architecture can be promoted, and there is a modular container system as a representative example of the industrialized architecture.

For example, there are dozens of grade-D and grade-E school buildings across South Korea which are structurally considered to be dangerous. Education should be carried out during the period of reconstruction or repair of these school buildings. Accordingly, recently, it is becoming common to construct a temporary building by using modular containers during the reconstruction of a school building and to use the temporary building as a temporary school building.

Utility Model Registration No. 20-0200410 discloses a technology in which a temporary building such as a temporary school building by using containers is built as described above.

According to a container building disclosed in Utility Model Registration No. 20-0200410, as illustrated in FIG. 1(*a*), ceilings 11 and 11' and bottom surfaces 12 and 12' are installed, and entrance doors 14 and 14' are formed on first side wall surfaces 13 and 13', respectively, and front and windows 16 and 16' are formed on rear surfaces 15 and 15', respectively, and first and second containers 10 and 10' from which second side wall surfaces are respectively removed are installed at opposite sides, respectively, and ceilings 21 and 21' and bottom surfaces 22 and 22' are installed between the first and second containers 10 and 10', and windows 24 and 24' are formed on front and rear surfaces 23 and 23', respectively, and third and fourth containers 20 and 20' from which opposite side wall surfaces are removed are connected and welded to each other, and these containers 10, 10', 20, and 20' are integrated with each other, and a partition 200 which separates a classroom from a corridor is installed inside the containers, and accordingly, the classroom illustrated in FIG. 1(*b*) can be formed.

However, each of the containers 10, 10', 20, and 20' manufactured in a factory has a certain amount of manufacturing error. Accordingly, when the containers are installed on a site, the finish of the joined parts of the containers is not beautiful. Accordingly, the containers 10, 10', 20, and 20' whose finish is completed 100% cannot be manufactured, and thus while the containers are assembled with each other on a site, final finishing materials are installed on the containers.

On the other hand, construction-related persons generally prioritize the quality of the main building of a school being reconstructed, so they only consider the ease of construction and demolition of a temporary building to be used as a temporary school building, and not fully consider the user's convenience. For example, in consideration of field workability such as transportation and lifting, the reduction of weights of modules is considered as an important factor. To this end, the inside of each of container modules used as a temporary school building is generally composed of plywood and wallpaper. Accordingly, a learning environment is very poor.

Furthermore, in a case in which a floor structure made of plywood is used, walkability is significantly reduced due to creaking occurring when students walk, and cold and moisture coming out from the ground greatly worsens a learning environment.

In order to solve the above problems, a floor concrete is generally poured on the inner floor of a temporary school building constructed by an assembly method disclosed in Utility Model Registration No. 20-0200410 described above. However, the pouring of the floor concrete not only increases construction period and cost, but also reduces the reuse rate of members to 50% or less.

Furthermore, the container modules are configured as a wall structure and are structurally weak when assembled with each other. Accordingly, when the container modules are stacked to form at least three floors, the container modules have a problem in structural safety such as earthquake resistance, and the reinforcement of the container modules is not easy.

In addition, as in Utility Model Registration No. 20-0200410 described above, when a corridor is installed inside the container module, only a school building having a one-way corridor can be constructed and cannot accommodate many classrooms in a narrow site condition, and the corridors of the container modules are not easy to be connected to each other as a flat surface, and the container modules have many parts damaged when dismantled, so the reuse rate thereof is low.

DISCLOSURE

Technical Problem

The present disclosure has been made to solve the problems occurring in the prior art due to the container module described above, and the present disclosure is intended to propose a method for constructing a relocatable building by using eco-friendly modules in which 100% complete modules including the internal finishing of the modules can be manufactured in a factory to minimize the amount of construction at a site, and the frame structures of pillars and beams integrated with each other by reinforcing means from a foundation to a roof are realized, whereby structural safety such as earthquake resistance is increased, a living environment such as airtightness and walkability is improved, and reuse rate of the modules is high.

Technical Solution

In order to accomplish the above objectives, according to a most preferred embodiment of the present disclosure, there is provided a method for constructing a relocatable building by using modules, the method including: a step a) of preparing a single module and installing a foundation block at a site; a step b) of forming a complex module having one room by assembling at least two single modules with each other on an assembly table near the site; a step c) of lifting the assembled complex module and installing the assembled complex module on the foundation block; and a step d) of installing a roof module on an uppermost complex module and integrally reinforcing the foundation block, the complex module, and the roof module by using a reinforcing means, wherein in the step d), the installing of the roof module includes coupling the roof module to the complex module by a coupling piece, and the integral reinforcing includes allowing a lower end of the reinforcing means to be fixed on the foundation block in a tensile state after the lower end of the reinforcing means passes through a through hole formed in the roof module, a through hole formed in the coupling piece, and a through hole formed in each of pillars of the complex module while an upper end of the reinforcing means is fixed to the roof module.

According to another embodiment of the present disclosure, there is provided the method for constructing a relocatable building by using modules in which the single module prepared in the step a) has a hexahedral shape and is configured such that a space opening is formed in any one surface of the single module, a middle coupling pillar is installed on each of opposite sides of the space opening, and a middle coupling horizontal beam is installed between the middle coupling pillars facing each other, whereby in the forming of the complex module of the step b), while space openings of two single modules are in contact with each other, middle coupling pillars of c other by fastening bolts.

In this case, at least any one of the middle coupling horizontal beam and the middle coupling pillar of the single module may be configured to have a cross section such that when assembling the single modules to each other in the step b), an installation groove into which an inflatable sealing material is inserted is formed inside each of the middle coupling horizontal beams coupled to each other or inside each of the middle coupling pillars coupled to each other, and without the installation groove, each of the middle coupling horizontal beams or each of the middle coupling pillars may have a stepped cross section to be fitted to each other by the stepped cross section.

According to still another embodiment of the present disclosure, there is the method for constructing a relocatable building by using modules in which the step c) includes a process of stacking the upper complex module on the lower complex module, wherein after installing the coupling piece on the upper end surfaces of the pillars of the lower complex module, each of the upper, lower, left, and right complex modules are integrated with each other by the coupling piece.

According to still another embodiment of the present disclosure, there is provided the method for constructing a relocatable building by using modules in which the step c) includes a process of installing a complex module on each of opposite sides of an aisle floor board after the aisle floor board is first installed.

Advantageous Effects

According to the present disclosure, the manufacturing of modules including interior and exterior finishing thereof is completed in a factory, and only simple assembly and fixing work such as bolting are performed at a site, thereby facilitating the construction of a building, and the modules are not damaged even during disassembly, thereby maximizing the reuse rate of the modules.

In addition, according to the present disclosure, the complex module assembled completely on the assembly table close to a site such that manufacturing errors thereof are corrected and airtightness thereof is secured is installed at the site, thereby securing high quality of a constructed building, and a professional skilled worker such as a plasterer is not required, thereby enabling the construction of an economical building.

Additionally, according to the present disclosure, through a first coupling by the coupling piece and a second coupling by the reinforcing means, integral reinforcement is performed from a foundation to the roof, thereby realizing a building which is improved in structural safety such as earthquake resistance.

BEST MODE

A method for constructing a relocatable building by using modules according to the present disclosure includes: a step a) of preparing a single module and installing a foundation block at a site; a step b) of forming a complex module having one room by assembling at least two single modules on an assembly table near the site; a step c) of lifting the assembled complex module and installing the complex module on the foundation block; and a step d) of installing a roof module on an uppermost complex module and integrally reinforcing the foundation block, the complex module, and the roof module by using a reinforcing means, wherein in the step d), the installing of the roof module includes coupling the roof module to the complex module by using a coupling piece, and the integral reinforcing includes allowing the lower end of the reinforcing means to be fixed on the foundation block in a tensile state after passing through a through hole formed in the roof module, a through hole formed in the coupling piece, and a through hole formed in a pillar of the complex module while the upper end of the reinforcing means is fixed to the roof module.

MODE FOR INVENTION

Hereinafter, an embodiment of the present disclosure will be described in detail with reference to the accompanying drawings. However, in the case of blurring or obscuring the technical idea of the present disclosure due to the detailed description of a known configuration in explaining the present disclosure, the description of the known configuration will be omitted.

According to the present disclosure, depending on the size of a building to be built which has a room, a single module 200A divided into two modules or an intermediate module 200B located between these single modules 200A is manufactured in a factory, and after the modules are assembled with each other on an assembly table 600 near a site to be the complex module 100 having one room, the complex module 100 is located at the installation place of the site.

Figure 1:
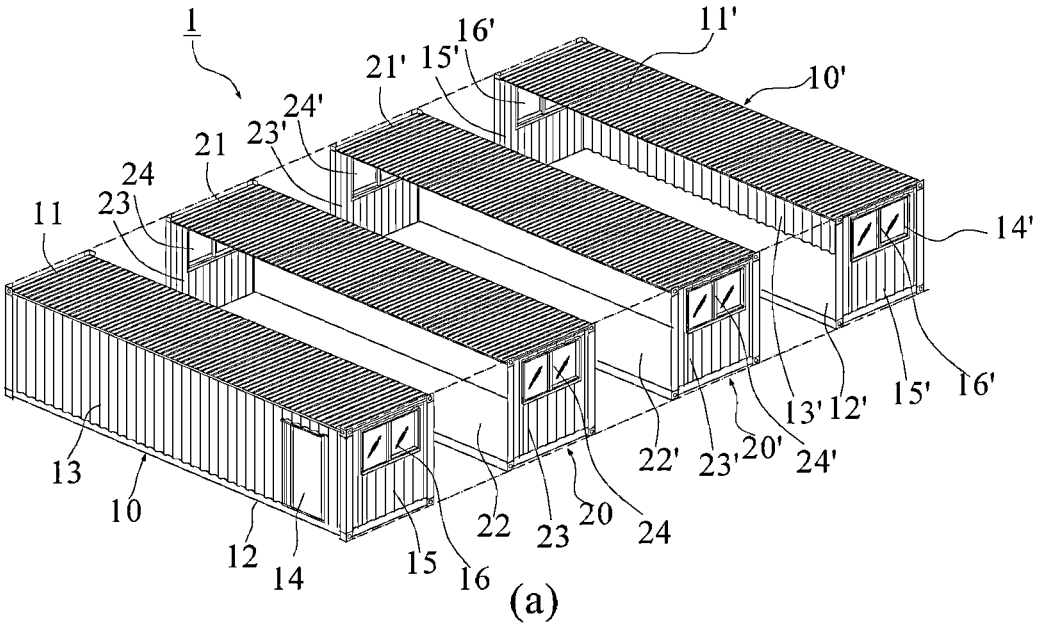
FIG. 1 is a view illustrated for explaining a conventional method for constructing a temporary building by using a container module.
Figure 1:
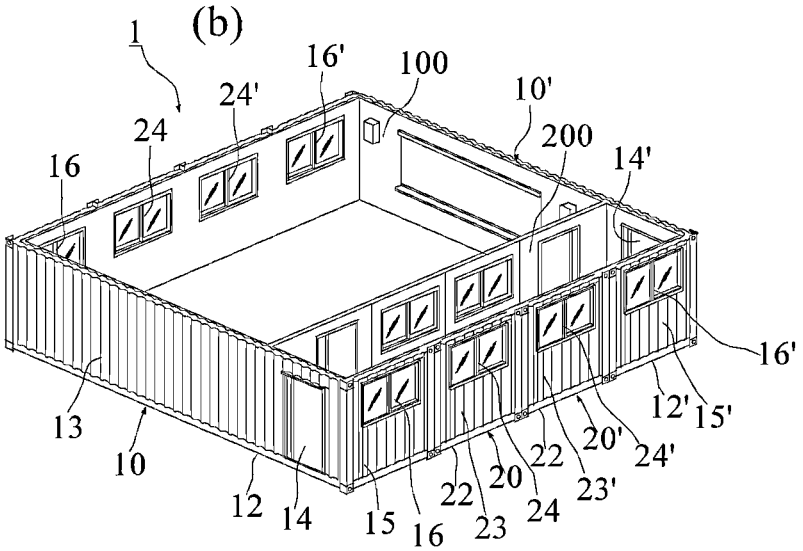
Figure 2:
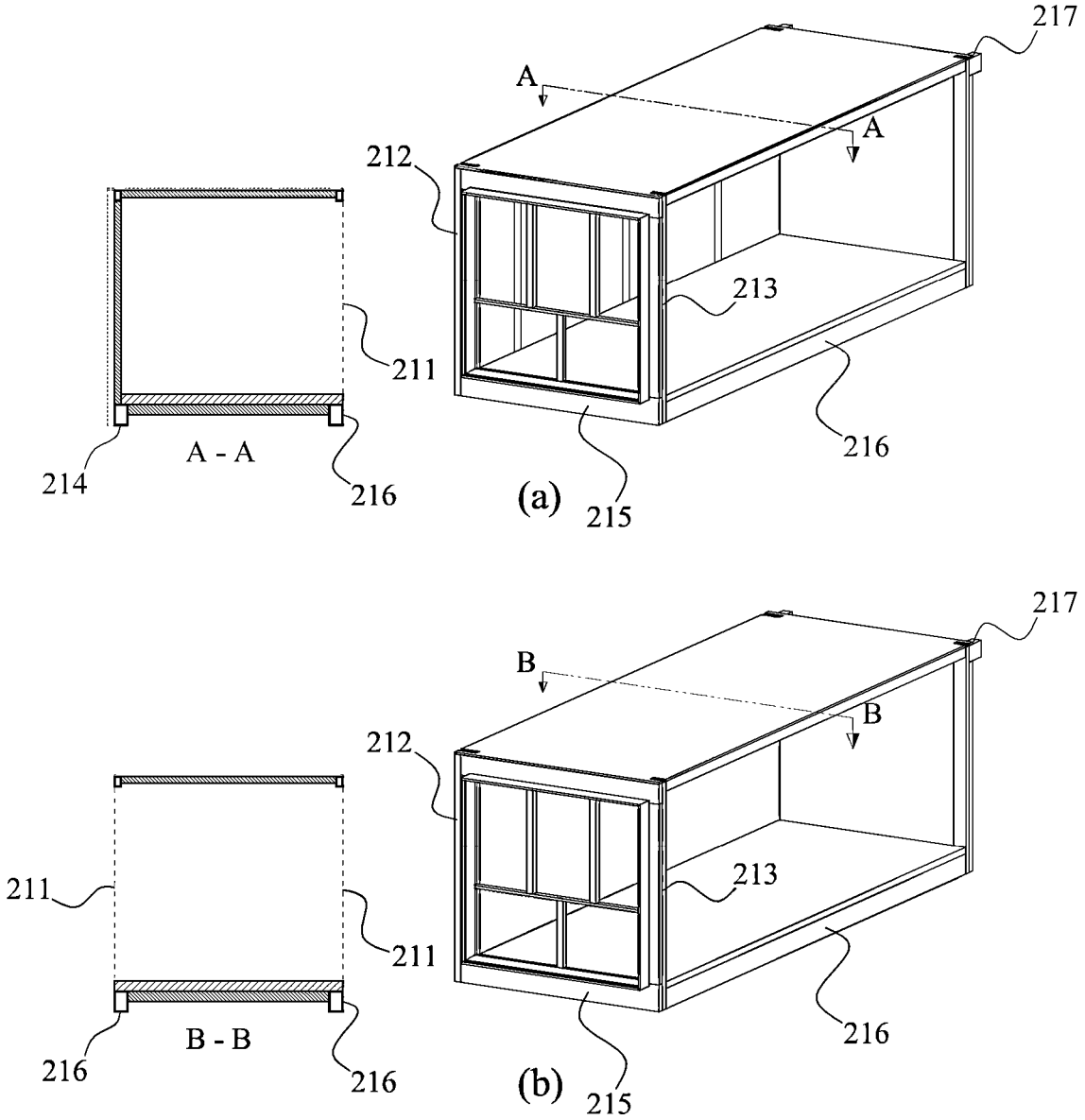
FIG. 2 is the perspective and sectional views of each module applied to the construction method of the present disclosure.

FIG. 2 illustrates each of the single module 200A and the intermediate module 200B, and as illustrated in 2(a), the single module 200A has a hexahedral shape and has a space opening 211 formed in any one surface thereof, and thus a space opening 211 of an associated single module 200A or intermediate module 200B coupled to the space opening 211 is bonded to the space opening 211 such that one room can be defined in the assembled complex module 100.

As illustrated in FIG. 2(*b*), the intermediate module 200B, which is further assembled as required, has a hexahedral shape and has space openings 211 formed respectively in opposite surfaces thereof.

The single module 200A includes outer pillars 212 located at the outer edges of space of the single module, and middle coupling pillars 213 located at the opposite sides of the space opening 211, wherein an edge horizontal beam 214 is installed between the outer pillars 212, and a vertically dividing beam 215 is installed between each of the outer pillars 212 and each of the middle coupling pillars 213, and a middle coupling horizontal beam 216 is installed between the middle coupling pillars 213 facing each other. A bottom floor is installed on the upper surface of the edge horizontal beam 214, vertically dividing beams 215, and the middle coupling horizontal beam 216, and a floor joist and a yoke which support the bottom floor may be installed on the lower part of the bottom floor.

On the other hand, the intermediate module 200B includes a middle coupling pillar 213 installed on each edge of the intermediate module, and middle coupling horizontal beams 216 are installed between the middle coupling pillars 213 between which the space openings 211 are located, and vertically dividing beams 215 are installed between the middle coupling pillars 213 except for the parts in which the middle coupling horizontal beams 216 are installed.

Each cross section of the middle coupling horizontal beam 216 and the middle coupling pillar 213 may vary depending on the purpose and required function of a building being constructed. Furthermore, depending on whether there is a corridor, a portion of the shape of the single module 200A may vary. This will be described in relation to a construction method to be described later.

The single module 200A and the intermediate module 200B are manufactured in a factory such that finishing thereof is completed 100%, so the construction of a building is completed only by assembly work without a separate finishing work at a site.

Figure 3:
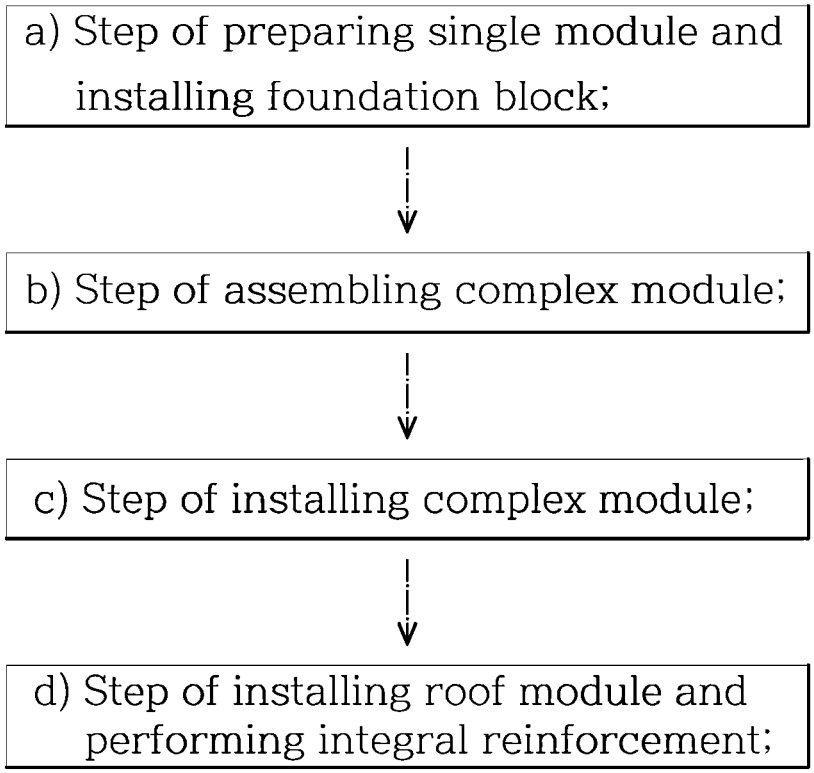
FIG. 3 is a process chart for the construction method of the present disclosure.

FIG. 3 is a flowchart of the construction method of the building described above. Here, a case in which two single modules 200A are assembled with each other to constitute one complex module 100 is described as an example.

As illustrated in FIG. 3, the construction method of a building according to the present disclosure includes the step a) of preparing the single modules 200A and installing foundation blocks 520, the step b) of forming the complex module 100, the step c) of installing the complex module 100, and the step d) of installing a roof module 400 and integrally reinforcing the associated parts. Each of the steps will be described in detail as follows.

Figure 4:
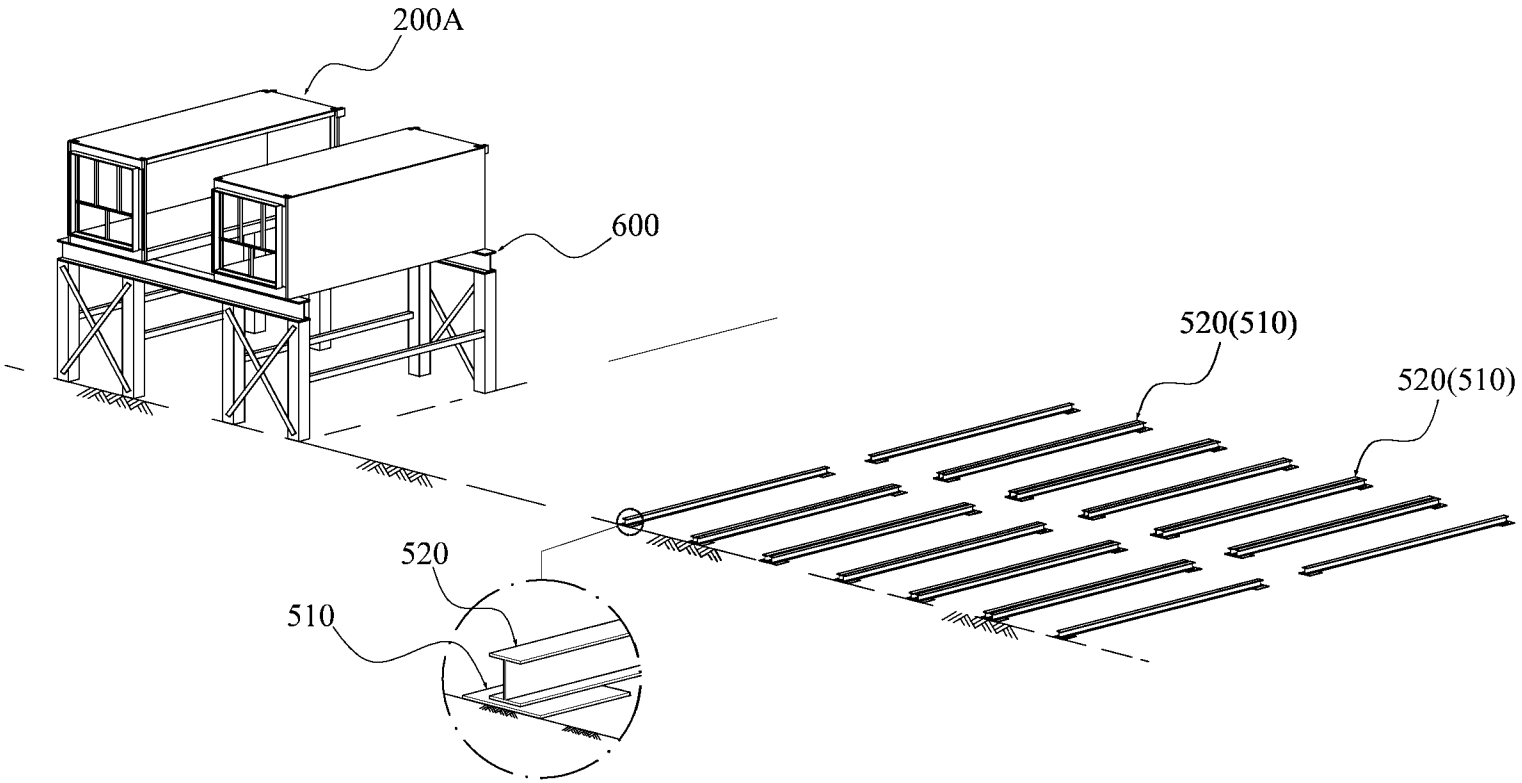
FIG. 4 is a perspective view illustrating the step of preparing a single module and installing a foundation block in the process of FIG. 3.

The step a) of preparing single modules (200A) and installing the foundation blocks 520 (FIG. 4);

The single modules 200A manufactured in a factory are transported and placed on the assembly table 600 near a site.

The assembly table 600 is a place on which the complex module 100 is formed by assembling the single modules 200A to each other and is placed at a position close to a site.

Furthermore, after leveling the ground at a location at which a building is required to be constructed, the foundation blocks 520 are installed. The means of reinforcing the ground may be further considered in consideration of the hardness of the ground, the load of the building to be constructed, and the period of use of the building, and the structure or size of each of the foundation blocks 520 may be set accordingly.

In this embodiment, after leveling the ground, a base steel plate 510 is laid on the ground such that a load is distributed on the surface of the ground and a horizontal level is adjusted, and the foundation blocks 520 are installed on the upper surface of the base steel plate 510. The lower space of the foundation block 520 installed to protrude from the ground may be used as a space for pipes of various facilities.

Figure 5:
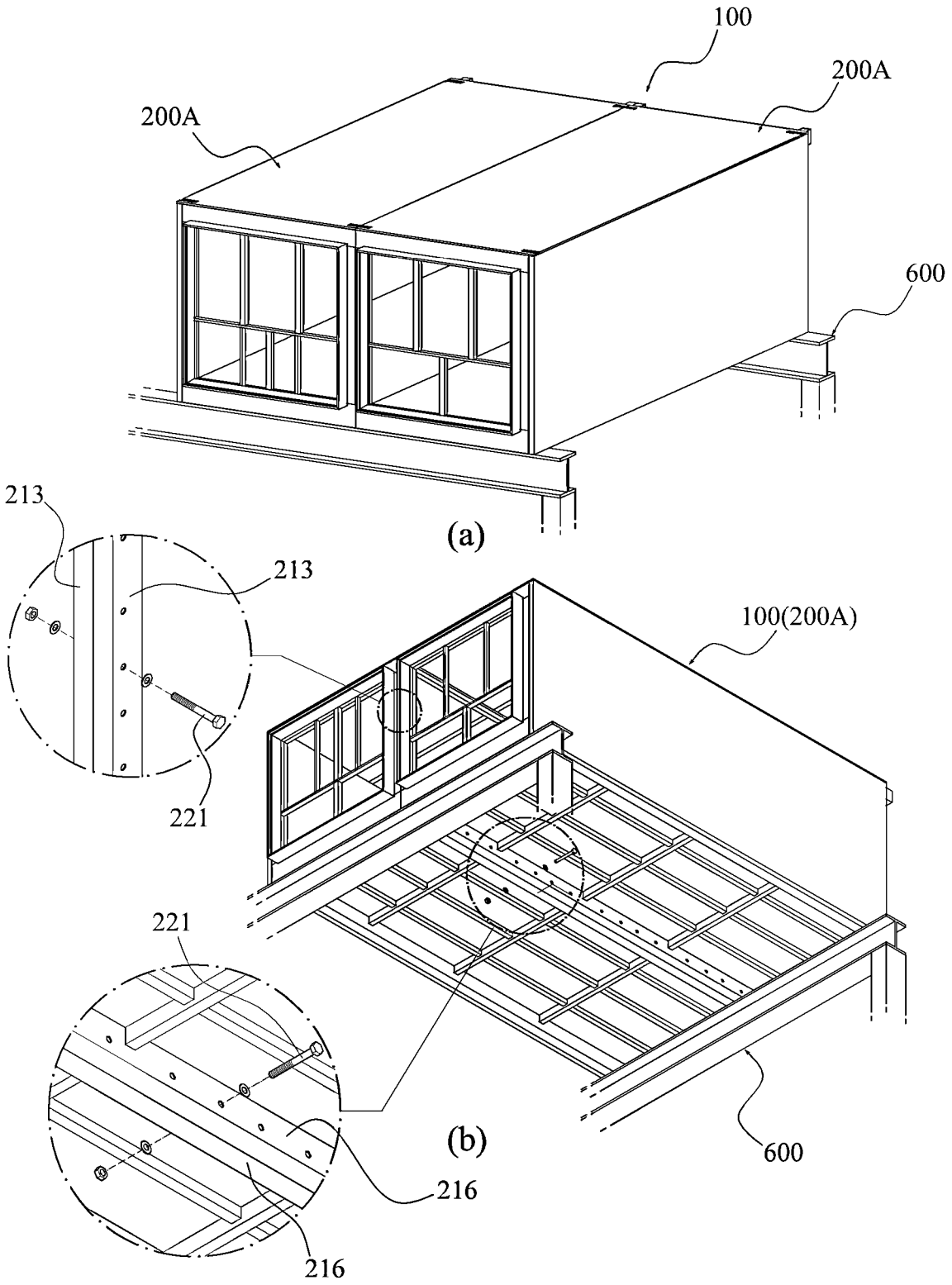
FIG. 5 is a perspective view illustrating the step of forming a complex module in the process of FIG. 3.
Figure 6:
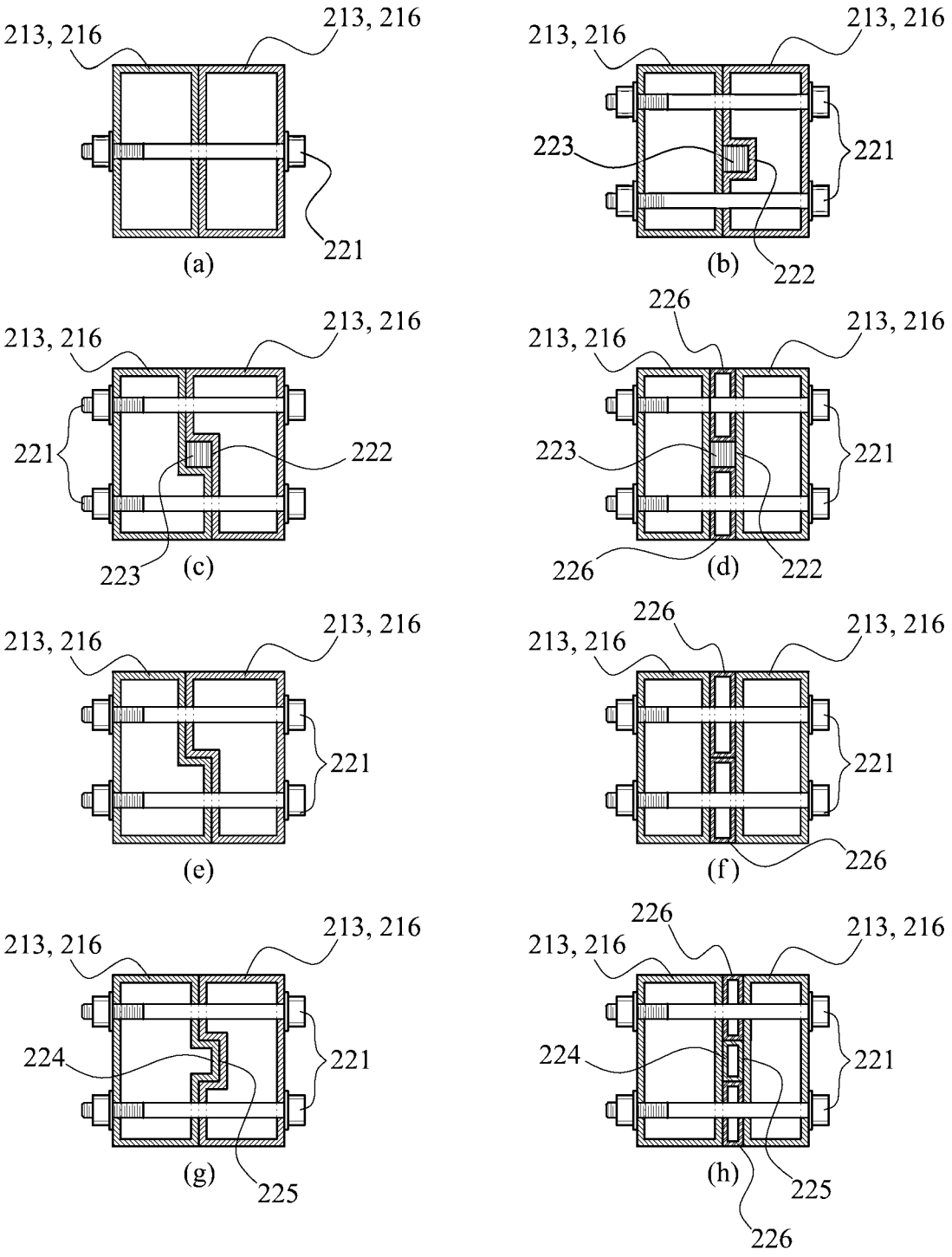
FIG. 6 illustrates cross-sectional views of embodiments of the shapes of cross sections of middle coupling horizontal beams and middle coupling pillars installed in the single modules.
Figure 7:
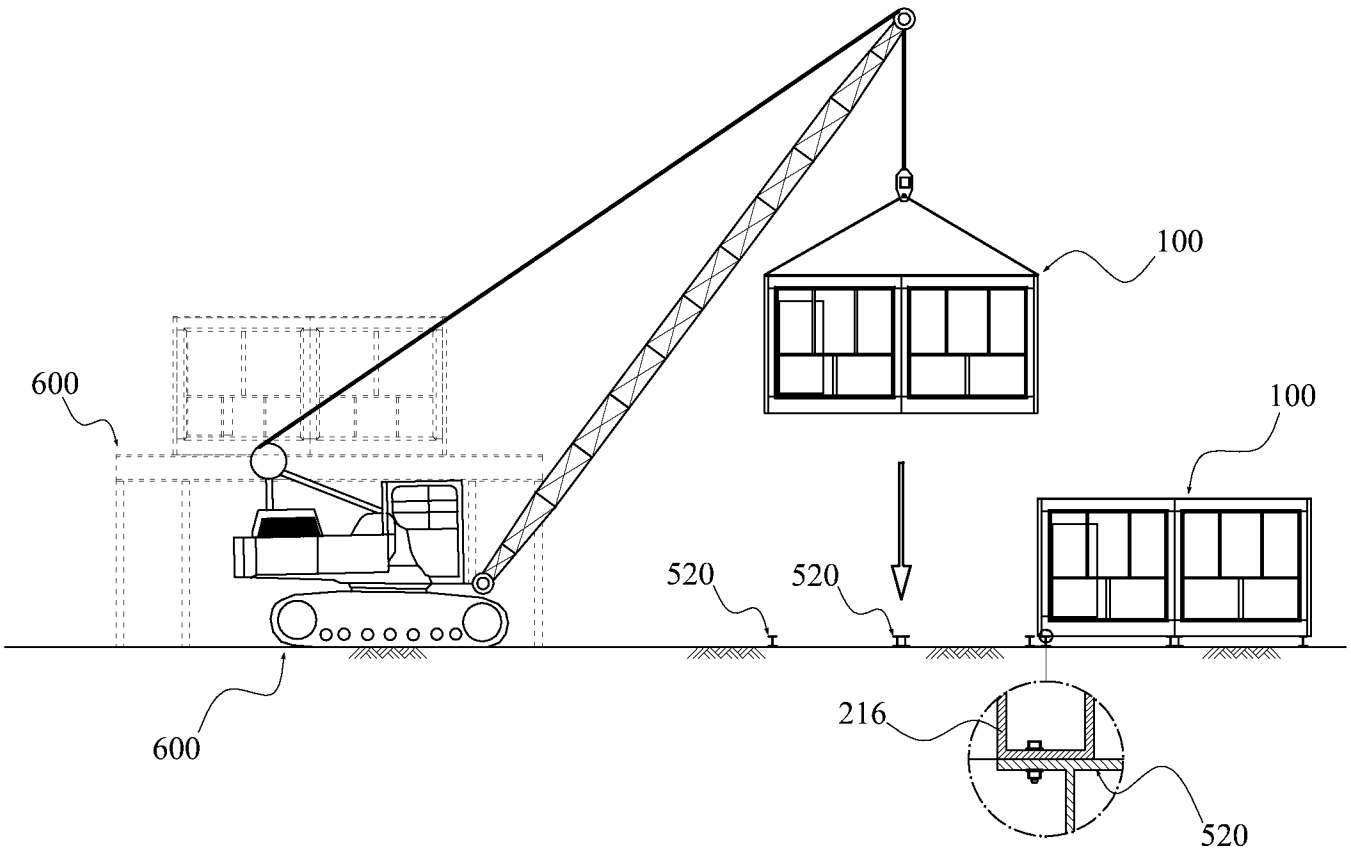
FIG. 7 is a view illustrating the step of installing the complex module in the process of FIG. 3.

The step b) forming the complex module 100 (FIGS. 5 and 6);

This step is a step of forming a complex module 100 of a standard which cannot be transported while requiring precise integrity, wherein at least two single modules 200A manufactured in transportable standards in a factory are assembled with each other to form the complex module 100 which is a larger module.

The assembly of these single modules 200A is not performed directly at an installation site as described above, but is performed on the assembly table 600 near the site such that the assembled complex module 100 can be installed at the site simply by being lifted.

Single modules 200A manufactured in a factory not only have certain amounts of manufacturing error, but also have a lot of room for construction error in a cramped site.

Accordingly, when the single modules 200A are directly assembled at the installation site, it deteriorates the finishing of the joined part of the inside of the complex module 100, which is required to have the highest integrity, and accordingly, an additional finishing work is required, thereby increasing the amount of work at the site.

Accordingly, in the present step, in the process of forming the complex module 100 on the assembly table 600 near the site as described above, manufacturing errors of the complex module are corrected such that the complex module 100 of high quality can be formed.

As illustrated in FIG. 5, two single modules 200A transported from a factory are assembled with each other such that while space openings 211 at opposite sides are in contact with each other, the middle coupling horizontal beams 216 and the middle coupling pillars 213 are integrated with each other by fastening bolts 221.

FIG. 6 illustrates the shapes of cross sections which can be applied to the middle coupling horizontal beams 216 and the middle coupling pillars 213 and coupled structures according to the shapes of the cross sections.

In FIG. 6(*a*), the cross section of each of the middle coupling horizontal beams 216 or the middle coupling pillars 213 is illustrated as a simple rectangle, and the middle coupling horizontal beams 216 and the middle coupling pillars 213 are integrated with each other by the fastening bolts 221, which may be applied to a case in which airtightness from the outside is not particularly required. In this case, the cross sections of the middle coupling horizontal beams 216 or the middle coupling pillars 213 of single modules 200A at opposite sides are not required to be different from each other, thereby making manufacturing advantageous.

FIGS. 6(*b*) to 6(*d*) illustrate examples of cases in which airtightness from the outside is greatly required, and an installation groove 222 is formed inside each of middle coupling horizontal beams 216 coupled to each other or inside each of middle coupling pillars 213 coupled to each other, and an inflatable sealing material 223 is inserted into the installation groove 222.

As illustrated in FIGS. 6(*b*) and 6(*c*), the installation groove 222 may be formed by middle coupling horizontal beams 216 or middle coupling pillars 213. As illustrated in FIG. 6(*d*), the installation groove 222 may be formed by placing a spacer 226 between middle coupling horizontal beams 216 coupled to each other or between middle coupling pillars 213 coupled to each other.

Accordingly, as described above, the inflatable sealing material 223 installed between the middle coupling horizontal beams 216 coupled to each other or between the middle coupling pillar 213 coupled to each other eliminates need for a separate sealing work during following construction at a site, which not only contributes to maximizing a finishing rate in a factory, but also promotes the simplification of on-site construction.

When the examples of FIGS. 6(*e*) to 6(*h*) are compared with the examples of FIGS. 6(*b*) to 6(*d*), although airtightness between single modules is somewhat inferior, the workability of bonding two members and integral behavior between the two members (here, "the members" refers to "middle coupling horizontal beams 216" or "middle coupling pillars 213.") are improved. That is, in FIGS. 6(*e*) and 6(*f*), since opposite members have stepped cross-sectional shapes, the members are placed in a precise coupling position only by aligning these stepped parts, and in FIGS. 6(*g*) and 6(*h*), a protrusion 224 formed on any one member and a recessed groove 225 formed in another member are placed at a precise coupling position only by fitting the protrusion 224 into the recessed groove 225, so a worker can immediately proceed with an integration work by the fastening bolts 221 without having to make an effort to precisely align the two members. The stepped shapes and the shapes of the recessed groove 225 and the protrusion 224 as described above may be formed by the middle coupling horizontal beams 216 or the middle coupling pillars 213, or may be formed by placing the spacer 226 between the middle coupling horizontal beams 216 or between the middle coupling pillars 213. The formation method of the shapes is not different from the above formation method of the installation groove 222.

When each of the middle coupling horizontal beams 216 or each of the middle coupling pillars 213 is configured to have an irregular cross section illustrated in each example of FIGS. 6(*b*), 6(*c*), 6(*e*), and 6(*g*), a part in which the middle coupling horizontal beam 216 is in contact with the middle coupling pillar 213 may have a cross-sectional shape different from the cross-sectional shapes of remaining sections such that the middle coupling horizontal beam 216 and the middle coupling pillar 213 can be easily connected to each other.

In the complex module 100 which is completely assembled, the middle coupling horizontal beams 216 and the middle coupling pillars 213 are integrated with each other by the fastening bolts 221, and thus even if some eccentricity occurs in single modules 200A coupled to each other during the lifting, the single modules 200A are prevented from being separated from each other.

The step c) of installing the complex module 100 (FIGS. 7 to 12);

By being lifted from the assembly table 600, the assembled complex module 100 is placed on the upper surface of the foundation blocks 520 of an installation site and is fixed thereto by fastening bolts. Adjacent complex modules 100 are connected to each other by coupling pieces 232.

Figure 8:
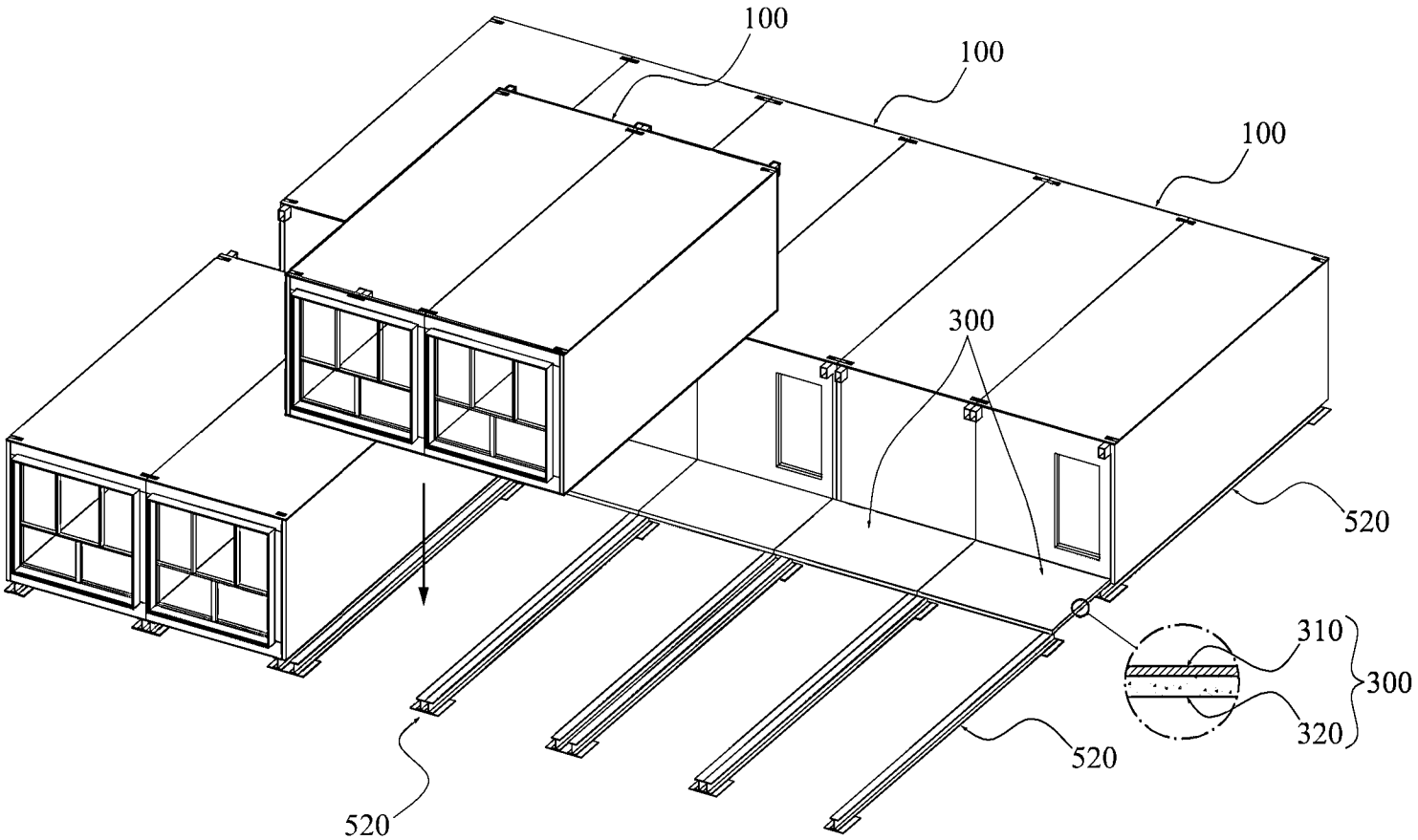
FIGS. 8 and 9 are perspective views illustrating the installation of an aisle floor board between complex modules

In the case of a planned building in which there is a corridor between complex modules 100 such that rooms defined by the complex modules 100 face each other, an aisle floor board 300 is installed between the complex modules 100 facing each other as illustrated in FIG. 8. The aisle floor board 300, together with the complex module 100, is placed on the foundation blocks 520.

The aisle floor board 300 may be formed by stacking a steel plate 310, which is thin and flat, on the upper surface of a lightweight aerated concrete panel 320. The thin steel plate 310 solves the weak surface strength and insufficient smoothness of the lightweight aerated concrete panel 320 which are the problems of the lightweight aerated concrete panel 320, and the lightweight aerated concrete panel 320 allows the thickness of the steel plate 310 to be thin and solves the problem of creaking while a person is walking.

Accordingly, the steel plate 310 and the lightweight aerated concrete panel 320 act complementarily.

Figure 9:
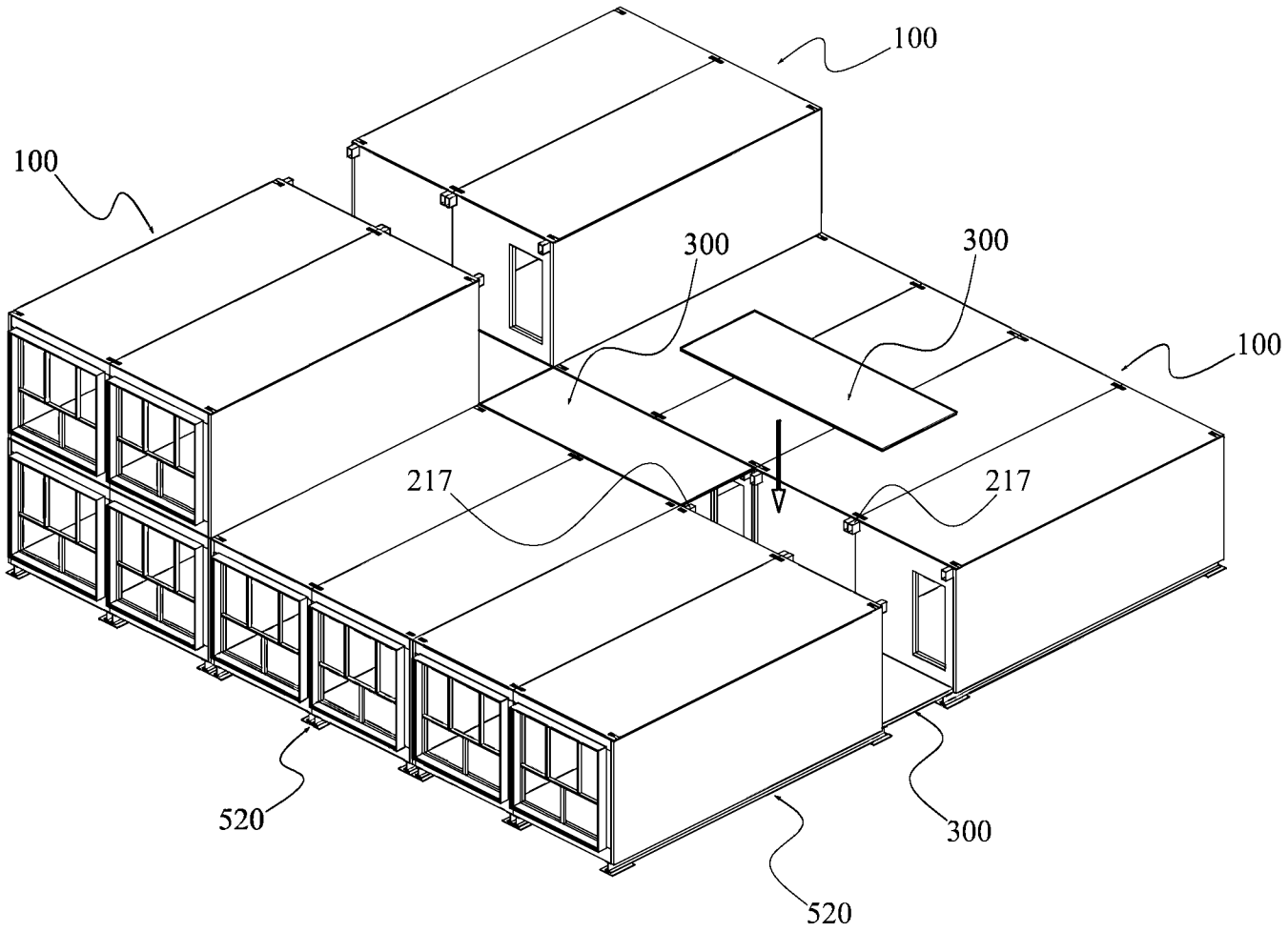

In the case of a planned building which has multiple floors and has a corridor between complex modules 100, as illustrated in FIG. 9, an aisle floor board 300 is first installed and then complex modules 100 are preferably installed on an associated floor. In a case in which the complex modules 100 are first installed, the aisle floor board 300 may be partially damaged by hitting the complex modules 100 in a process in which the aisle floor board 300 is lowered to a position between the complex modules 100 so as to install the aisle floor board 300. Accordingly, as described above, after the installation of the aisle floor board 300, the complex modules 100 are installed, which prevents the above problem. That is, after the aisle floor board 300 is first installed, the complex modules 100 are installed respectively at the opposite sides of the aisle floor board 300 such that a building having a corridor can be built. The installation of the complex modules 100 after the installation of the aisle floor board 300 may be applied directly to a single-story structure.

An aisle floor board 300 on an upper floor is installed on a lower complex module 100. Accordingly, in the case of a building which has multiple floors and has a corridor between the complex modules, the single module 200A is manufactured by having mounting protrusions 217 protruding outward from the front surface of a vertically dividing beam 215 located at the upper part of the single module.

Figure 10:
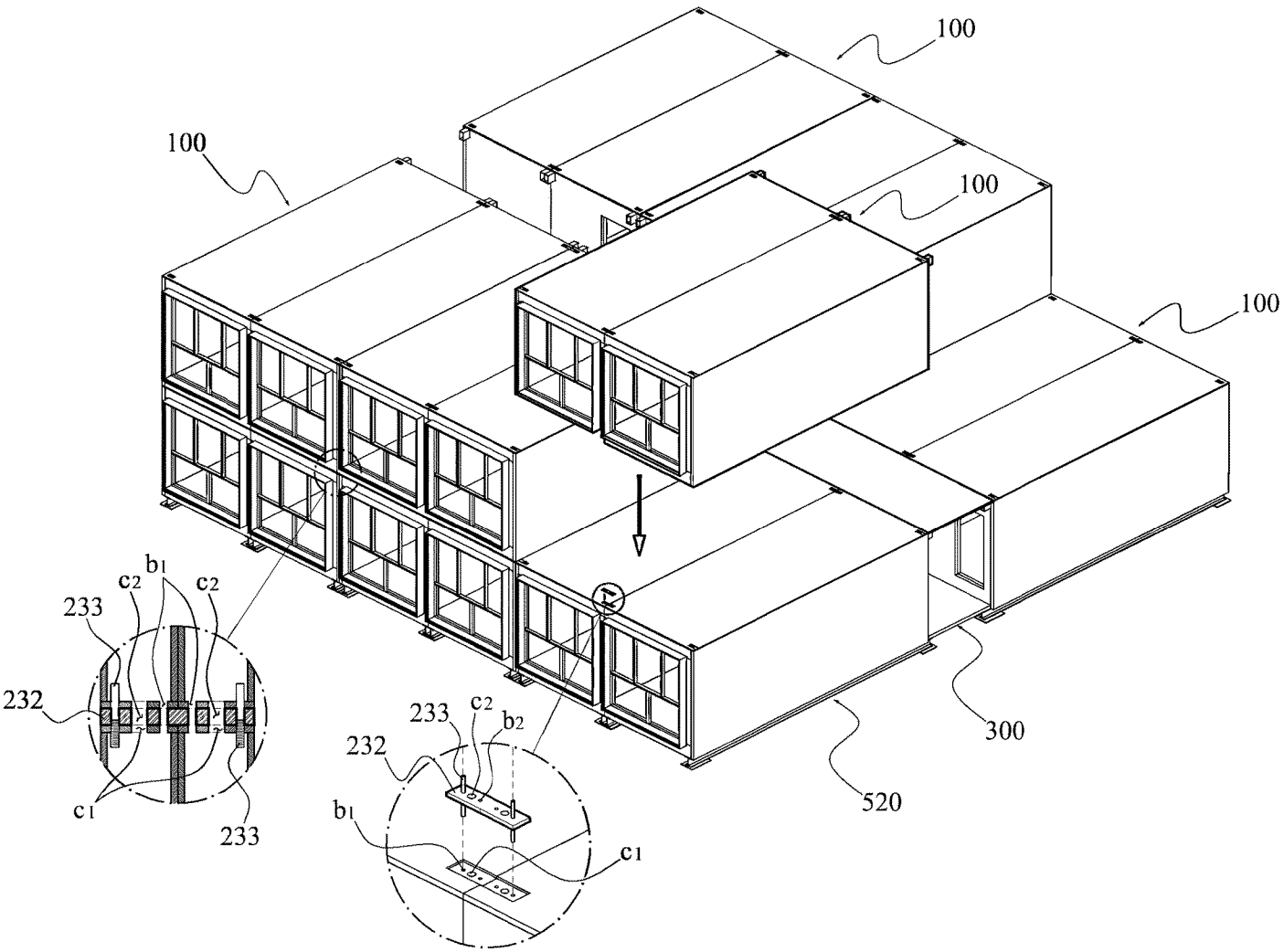
FIG. 10 is a perspective view illustrating the process of stacking an upper complex module on a lower complex module.

FIG. 10 illustrates a process in which an upper complex module 100 is stacked on the lower complex module 100.

The coupling of the upper and lower complex modules 100 to each other and the coupling of right and left complex modules 100 to each other are performed by integrally connecting the pillars 212 and 213 to each other, which are located at upper and lower sides and left and right sides, by a plate-shaped coupling piece 232 and a guide protrusion 233 as illustrated in FIG. 10.

Figure 11:
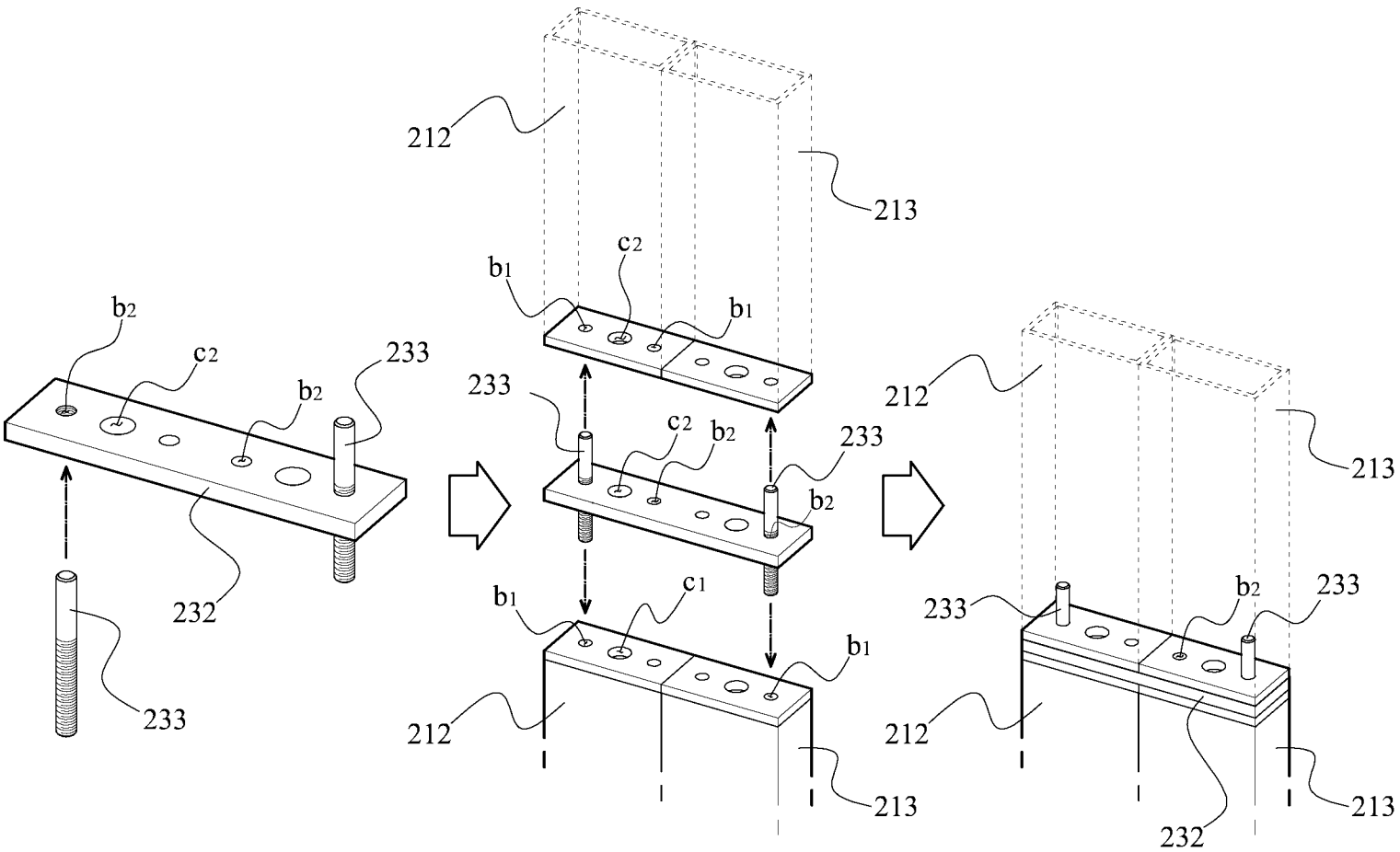
FIGS. 11 and 12 are embodiments of the configurations of a coupling piece coupling the complex modules to each other and a guide protrusion.
Figure 12:
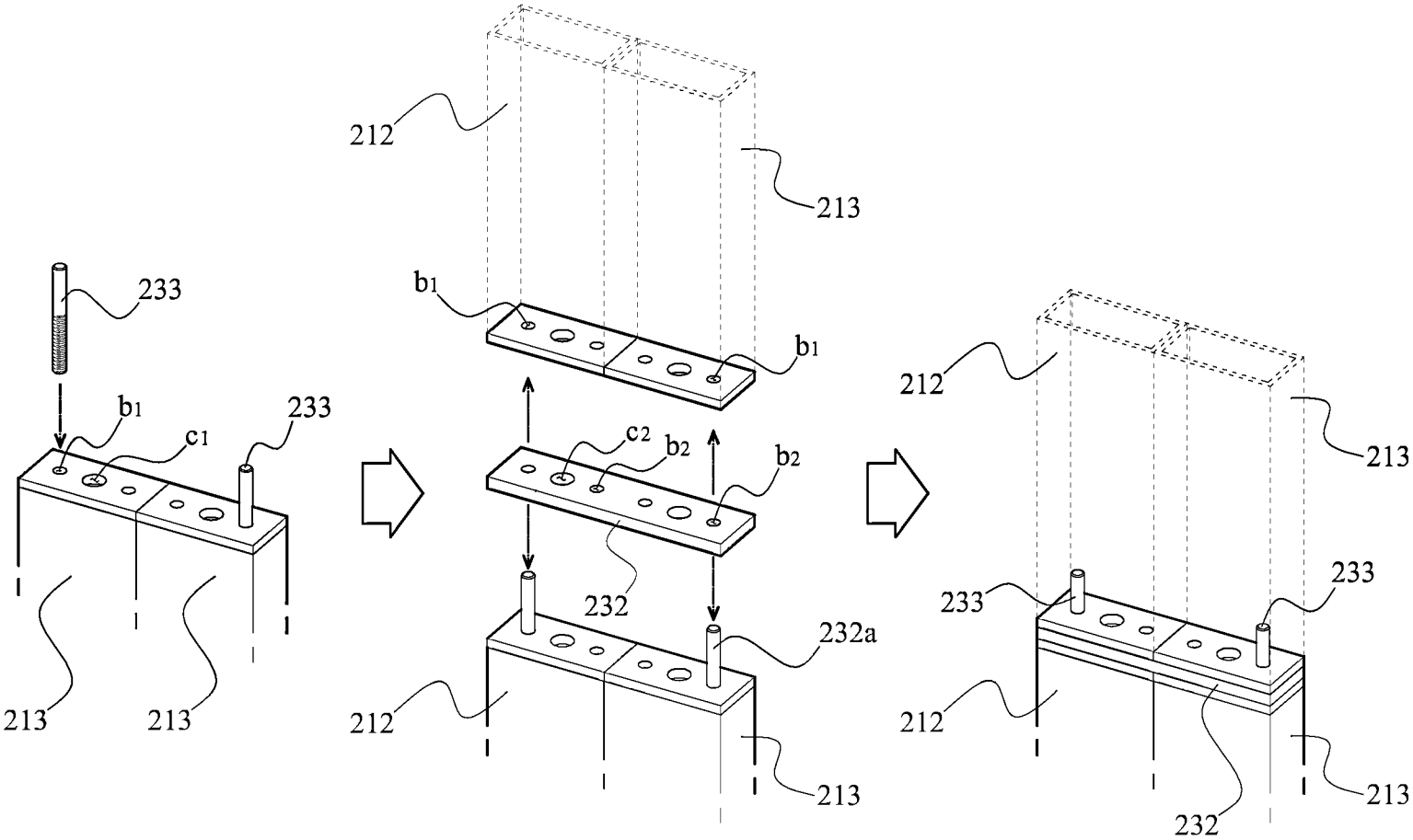

FIGS. 11 and 12 illustrate the configurations of the coupling piece 232 and the guide protrusion 233.

The coupling piece 232 is provided with one or two through holes $c_2$, and one guide groove $b_2$ is formed in each of the opposite sides of each of the through holes $c_2$ relative to each of the through holes $c_2$, and one through hole $c_1$ is formed in each of the upper and lower end surfaces of each of the pillars 212 and 213 and a guide groove $b_1$ is formed in each of the opposite sides of the through hole $c_1$. Furthermore, the roof module 400 to be described later is also provided with through holes $c_3$ and guide grooves $b_3$ corresponding to the through holes and guide grooves of the coupling piece 232.

A portion of the guide grooves $b_1$ formed in the upper end surface of each of the pillars 212 and 213 is used as a means for installing a lifting hook when the complex module 100 is lifted to be installed at a site after the complex module 100 is assembled on the assembly table. Accordingly, even if any one of the guide grooves $b_1$ formed in the opposite sides of the through hole $c_1$ of relative to the through hole $c_1$ as described above is damaged during the lifting process, a remaining guide groove $b_1$ is used such that the guide protrusion 233 to be described later can be installed.

The guide protrusion 233 may have the structure of being removably installed in the guide groove $b_2$ provided in the coupling piece 232 as illustrated in FIG. 11, and may have the structure of being removably installed in any one of the guide grooves $b_1$ provided in each of the upper and lower end surfaces of each of the pillars 212 and 213 as illustrated in FIG. 12.

One coupling piece 232 is placed on the upper and lower end surfaces of each of the pillars 212 and 213 of the complex module 100 adjacent to each other at left and right sides and sets the position of the guide protrusion 233 such that the complex modules 100 at upper, lower, left, and right sides are coupled to each other.

For example, in the embodiment of FIG. 11, two guide protrusions 233 are first fixed in the respective guide grooves $b_2$ provided in the coupling piece 232 such that the guide protrusions 233 protrude in the upper and lower directions of the coupling piece 232. In this case, any one of the guide protrusions 233 is required to be arranged to be located at the pillar 212 or 213 of the complex module 100 located at a left side, and the other one of the guide protrusions 233 is required to be arranged to be located at the pillar 212 or 213 of the complex module 100 located at the right side.

Next, the lower part of each of the guide protrusions 233 installed fixedly in the coupling piece 232 is inserted into each of the guide grooves $b_1$ provided in the upper end surface of each of the pillars 212 and 213 of the complex module 100 at lower left and right sides, and accordingly, the complex modules 100 at the left and right sides are coupled to each other.

In addition, finally, the upper complex module 100 is placed on the upper surface of the lower complex module 100 such that the lower part of each of the guide protrusions 233 protruding in the upper direction of the coupling piece 232 is inserted into each of the guide grooves $b_1$ provided in the lower end surface of each of the pillars 212 and 213.

The embodiment of FIG. 12 is different from the embodiment of FIG. 11 only in that after the lower part of the guide protrusion 233 is first inserted into the guide groove $b_1$ provided in the upper end surface of each of the pillars 212 and 213 of the left and right of the lower complex module 100, the protruding part of the upper part of the guide protrusion 233 passes through the guide groove $b_2$ provided in the coupling piece 232.

On the other hand, the two guide protrusions 233 are installed through the guide grooves $b_1$, $b_2$, and $b_3$ such that the respective through holes $c_1$, $c_2$, $c_3$ of the pillar 212 or 213, the coupling piece 232, and the roof module 400 are in precise alignment with each other, and this enables the work of an integral reinforcement step in the next step to be performed precisely and easily.

After first installing the aisle floor board 300, the process of installing the complex modules 100 is repeated, and the installation of the uppermost complex module 100 of a building is completed.

Figure 13:
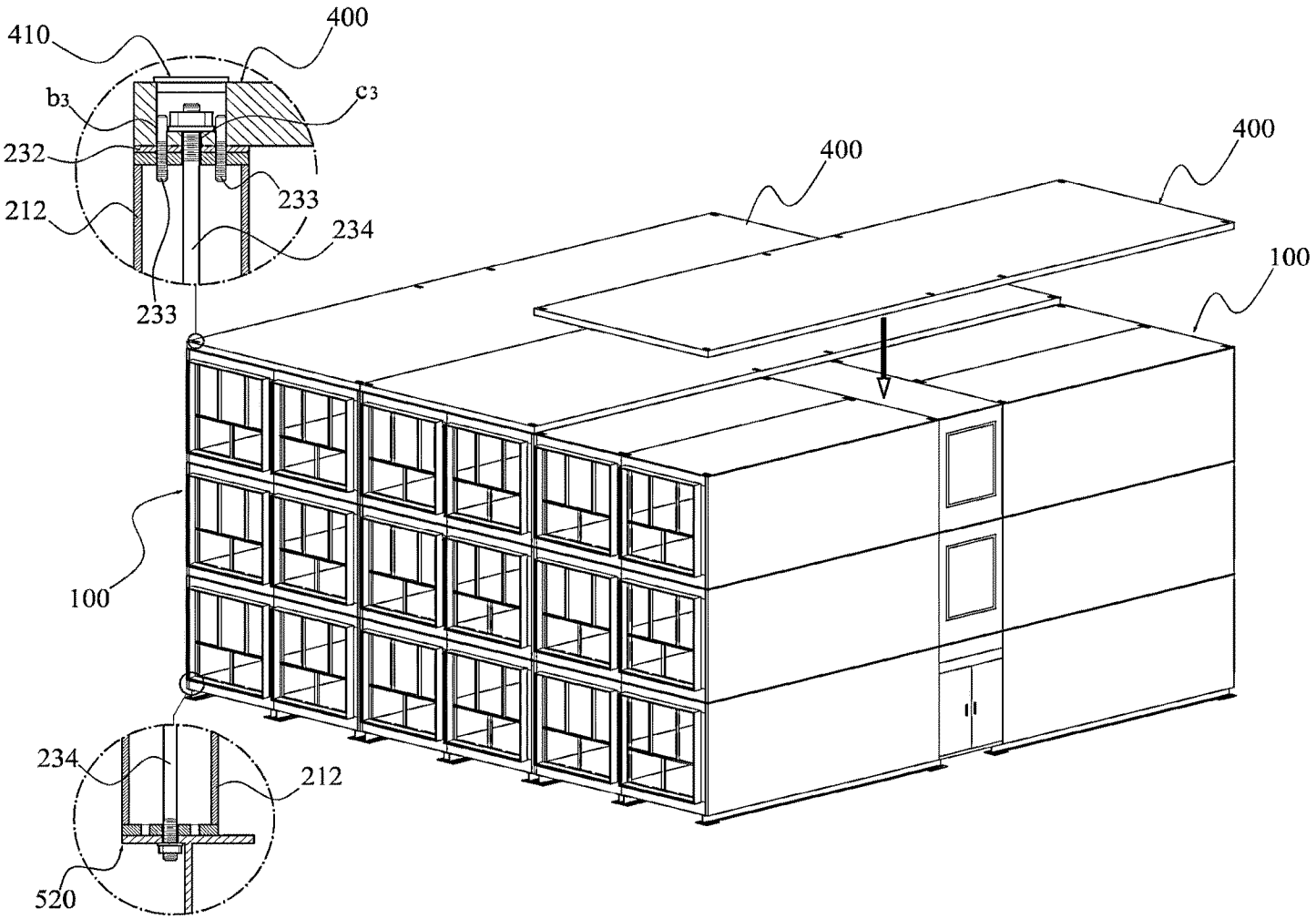
FIG. 13 is a perspective view illustrating the step of installing a roof module and performing integral reinforcement in the process of FIG. 3.

The step d) of installing the roof module 400 and integrally reinforcing the associated parts (FIG. 13);

When the installation of the complex modules 100 is completed to match the scale of a planned building, the roof module 400 into which an insulating material is inserted is installed on the uppermost complex module 100. The complex module 100 is first coupled to the roof module 400 by the guide protrusion 233 and the coupling piece 232 in which the through holes $c_2$ are formed, and this coupling method is not different from the method of the coupling of the upper and lower complex modules 100 to each other.

When the installation of the roof module 400 is completed, a reinforcing means 234 is installed between the roof module 400, the complex module 100, and the foundation block 520 so as to perform a second coupling therebetween, and through this second coupling, the integration of the entirety of a building is secured. The reinforcing means 234 may function as a tension member and may be a steel bar or stranded steel wire.

The reinforcing means 234 passes through the through hole $c_3$ formed in the roof module 400, the through hole $c_1$ formed in each of the pillars 212 and 213 of the complex module 100, and the through hole $c_2$ formed in the coupling piece 232 installed therebetween, and the upper end of the reinforcing means 234 is fixed on the roof module 400, and the lower end thereof is fixed on the foundation block 520 in a tensile state such that the entirety of a building has a high degree of integration, thereby improving seismic performance.

A waterproof cap 410 is installed on the through hole of the roof module 400 on which the upper end of the reinforcing means 234 is fixed such that rainwater is prevented from being introduced inside the roof module through the through hole $c_3$.

In the above, the present disclosure has been described in detail with reference to the specific embodiment, but the above embodiment is only an example to make the present disclosure easier to understand. Accordingly, it is self-evident that those with ordinary knowledge in this field will be able to implement the embodiment by modifying the embodiment in various ways within the scope of the technical idea of the present disclosure. Accordingly, such modifications fall within the scope of the present disclosure as described in the claims.

INDUSTRIAL APPLICABILITY

The present disclosure relates generally to a method for constructing a building by using modules. More particularly, the present disclosure relates to a method for constructing a relocatable building in which modules manufactured in a factory are transported to a site and are simply assembled with each other at the site so as to construct a building, which has repeated same sections, such as a school, an apartment, a hospital, a lodging facility, an office, and an accommodation facility, etc., and the disassembly of the modules are easy and reuse rate of the modules is high. Accordingly, the present disclosure can be considered to have industrial applicability.

The invention claimed is:

1. A method for constructing a relocatable building by using modules, the method comprising:

a step a) of preparing a single module (200A) and installing a foundation block (520) at a site; a step b) of forming a complex module (100) having one room by assembling at least two single modules (200A) with each other on an assembly table (600) near the site; a step c) of lifting the assembled complex module (100) and installing the assembled complex module (100) on the foundation block (520); and a step d) of installing a roof module (400) on an uppermost complex module (100) and integrally reinforcing the foundation block (520), the complex module (100), and the roof module (400) by using a reinforcing means (234), wherein the step a) comprises a process of installing the foundation block (520) on an upper surface of a base steel plate (510) after laying the base steel plate (510) on a ground surface, in the step d), the installing of the roof module (400) comprises coupling the roof module (400) to the complex module (100) by a coupling piece (232), and the integral reinforcing comprises allowing a lower end of the reinforcing means (234) to be fixed on the foundation block (520) in a tensile state after the lower end of the reinforcing means (234) passes through a through hole ($c_3$) formed in the roof module (400), a through hole ($c_2$) formed in the coupling piece (232), and a through hole ($c_1$) formed in each of pillars (212, 213) of the complex module (100) while an upper end of the reinforcing means (234) is fixed to the roof module (400), the coupling piece (232) is provided with two through holes ($c_2$) and a guide groove ($b_2$) formed in each of opposite sides of each of these through holes ($c_2$) relative thereto, the through holes ($c_1$, $c_3$) and guide grooves ($b_1$, $b_3$) corresponding respectively to the through hole ($c_2$) and the guide groove ($b_2$) are respectively formed in each of upper and lower end surfaces of each of the pillars (212, 213) of the complex module (100) and in the roof module (400), and the guide grooves ($b_1$, $b_2$, $b_3$) communicate with each other, and thus a guide protrusion (233) is removably inserted into the guide grooves, so that upper, lower, left, and right complex modules (100) are integrally coupled to each other.

2. The method of claim 1, wherein the step c) comprises a process of stacking the upper complex module (100) on the lower complex module (100), wherein after installing the coupling piece (232) on the upper end surfaces of the pillars (212, 213) of the lower complex module (100), each of the upper, lower, left, and right complex modules (100) are integrated with each other by the coupling piece (232).

3. The method of claim 1, wherein the single module (200A) prepared in the step a) has a hexahedral shape and is configured such that a space opening (211) is formed in any one surface of the single module (200A), a middle coupling pillar (213) is installed on each of opposite sides of the space opening (211), and a middle coupling horizontal beam (216) is installed between the middle coupling pillars (213) facing each other, whereby in the forming of the complex module (100) of the step b), while space openings (211) of two single modules (200A) are in contact with each other, middle coupling pillars (213) of the two single modules (200A) are integrated with each other by fastening bolts (221), and middle coupling horizontal beams (216) of the two single modules (200A) are integrated with each other by fastening bolts (221).

4. The method of claim 3, wherein at least any one of the middle coupling horizontal beam (216) and the middle coupling pillar (213) of the single module (200A) is configured such that when assembling the single modules (200A) to each other in the step b), an installation groove (222) into which an inflatable sealing material (223) is inserted is formed inside each of the middle coupling horizontal beams (216) coupled to each other or inside each of the middle coupling pillars (213) coupled to each other.

5. The method of claim 4, wherein the installation groove (222) is formed by placing a spacer (226) between the middle coupling horizontal beams (216) coupled to each other or between the middle coupling pillars (213) coupled to each other.

6. The method of claim 3, wherein at least any one of the middle coupling horizontal beam (216) and the middle coupling pillar (213) of the single module (200A) is configured to have a stepped cross section, and during the assembly of the single modules (200A) in the step b), each of the middle coupling horizontal beams (216) or each of the middle coupling pillars (213) is fitted to each other by the stepped cross section.

7. The method of claim 1, wherein the step c) comprises a process of installing a complex module on each of opposite sides of an aisle floor board (300) after the aisle floor board (300) is first installed.

* * * * *